US005255463A

United States Patent [19]

Werner

[11] Patent Number: 5,255,463

[45] Date of Patent: Oct. 26, 1993

[54] ROTATING SIGN ASSEMBLY

[76] Inventor: Paul H. Werner, 12326 E. McNichols, Detroit, Mich. 48205

[21] Appl. No.: 815,859

[22] Filed: Jan. 2, 1992

Related U.S. Application Data

[63] Continuation of Ser. No. 389,635, Aug. 4, 1989, abandoned.

[51] Int. Cl.[5] ..... G09F 11/02

[52] U.S. Cl. ..... 40/505; 40/503; 74/84 R

[58] Field of Search ..... 40/503, 504, 505, 507, 40/484, 473; 74/84 R, 436

[56] References Cited

U.S. PATENT DOCUMENTS

| | | | |
|---|---|---|---|
| 865,356 | 9/1907 | Carr | 40/505 |
| 1,399,409 | 12/1921 | Sleder | 40/505 |
| 1,785,204 | 12/1930 | Nelson et al. | 40/505 |
| 2,605,647 | 8/1952 | Duvoisin | 74/436 |
| 3,077,685 | 2/1963 | Gellich . | |
| 3,375,600 | 4/1968 | Poulos . | |
| 3,428,765 | 2/1969 | Ludwig . | |
| 3,496,791 | 2/1970 | Gabriel | 74/436 |
| 3,855,873 | 12/1974 | Fletcher et al. | 74/436 |
| 3,918,183 | 11/1975 | Poulos . | |
| 4,001,810 | 1/1977 | Olsen . | |
| 4,407,084 | 10/1983 | Uihlein et al. . | |
| 4,606,235 | 8/1986 | Kindt | 74/436 |
| 4,638,580 | 1/1987 | Giannetti et al. | 40/503 |

FOREIGN PATENT DOCUMENTS

| | | | |
|---|---|---|---|
| 621205 | 5/1927 | France | 74/436 |

*Primary Examiner*—Kenneth J. Dorner
*Assistant Examiner*—Brian K. Green
*Attorney, Agent, or Firm*—Gifford, Groh, Sprinkle, Patmore and Anderson

[57] ABSTRACT

A rotating sign assembly includes a number of multi-sided, rotatable sign segments driven by an elongated drive shaft operably interconnected with each of the sign segments. The drive shaft includes at least one multi-armed driven cam fitted to the drive shaft. Each arm of the driven cam includes an outer sloped driving surface and a peaked extremity. The driven cam is rotatably driven by a driving arm assembly comprising a driving pin plate and a driven arm stop plate. The driving pin plate includes a pair of pins, one situated on each end of the plate. Each driving pin alternatingly interacts with the outer sloped surfaces of the cam for rotation thereof, this rotation being halted by interaction of the peaked extremities alternatingly with the ends of the stop plate.

14 Claims, 2 Drawing Sheets

ROTATING SIGN ASSEMBLY

This is a continuation of copending application Ser. No. 07/389,635 filed on Aug. 4, 1989, now abandoned.

BACKGROUND OF THE INVENTION

I. Field of the Invention

The present invention relates generally to rotating sign assemblies. More particularly, the present invention relates to a rotating sign assembly incorporating a multi-armed driven cam and a driving assembly for alternatingly driving then halting the rotating motion of the driven cam.

II. Description of the Relevant Art

Roadside signs have long been effective means of advertising and conveying messages. Memories of the sequential "Burma Shave" signs still bring a smile to many drivers. More conventional "billboard" style signs have been used along highways across the country.

Known billboard style signs are advantageous in that they successfully advertise a message to a broad audience for a relatively low price. However, these signs suffer from a severe disadvantage in that their displayed message may be posted for weeks or months limiting their effectiveness over the long term. The viewing audience simply becomes bored of the same inanimate sign flashing the same message, and its marketing effectiveness drops off significantly over time.

In response to conventional forms of billboard advertising, rotating signs were developed. These signs typically comprise a number of three-sided sign segments driven by a motor that selectively starts and stops or by a motor having mechanically engaged therewith a trip mechanism or clutch.

However, known rotating sign actuators are highly complex, thereby subjecting them to frequent mechanical or electrical failure in addition to being of high construction cost. Accordingly, because prior approaches to solving the problems of providing an economic and dependable rotating sign have failed, such a system is desired.

SUMMARY OF THE PRESENT INVENTION

The present invention provides a rotating sign assembly which includes a number of multi-sided, rotatable sign segments provided in a side-by-side relationship with respect to each other. The sign segments are operably engaged with a transversely-mounted drive shaft which rotates to simultaneously turn the segments.

The drive shaft includes at least one multi-armed driven cam fitted to the shaft. Each arm of the driven cam includes an outer sloped driving surface and a peaked extremity. The degree of slope may be altered when the cam is manufactured or machined to thereby change the rate of speed rotation of the sign. Thus by altering the slope of the arm rotation of the sign segments from one image to the next (from one side to the next) the rotation can be, for example, slow at the beginning of the rotation and fast at the end or vice versa. Of course, the slope can be selected so as to make the rotation operate at a uniform speed from beginning to end.

The driven cam is driven by a driving arm assembly comprising three components including an elongated driving pin plate having a pair of driving pins fitted thereon, one pin being provided at each end of the pin plate. The second component is an elongated stop plate having curved ends. The third component is a drive motor having a drive shaft onto which the plates are fitted. The plates are offset with respect to one another.

Each driving pin alternatingly interacts with each consecutive outer sloped surface of the cam for rotation thereof, this rotation being halted by interaction of the peaked extremities with the curved ends of the stop plate.

The construction of the present assembly improves over known rotating sign assemblies in that it operates efficiently with a minimal number of parts, thus reducing both the costs of construction and maintenance.

Other advantages and features of the present invention will become more apparent from the following detailed description when read in conjunction with the accompanying drawings.

BRIEF DESCRIPTION OF THE DRAWING

The present invention will be more fully understood by reference to the following detailed description of the preferred embodiments of the present invention when read in conjunction with the accompanying drawing in which like reference characters refer to like parts throughout the views, and in which.

DETAILED DESCRIPTION OF THE PREFERRED EMBODIMENT OF THE PRESENT INVENTION

Figure 5:
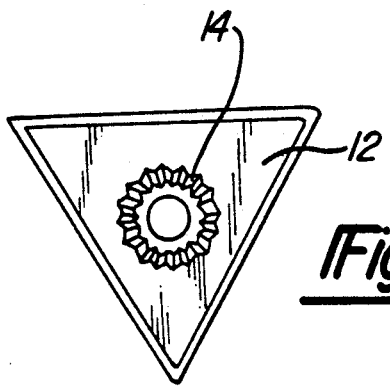
FIG. 5 is a top view of one of the sign segments of the present invention.

The drawing discloses the preferred embodiment of the present invention. While the configuration according to the illustrated embodiment is preferred, it is envisioned that alternate configurations of the present invention may be adopted without deviating from the invention as portrayed. The preferred embodiment is discussed hereafter.

Figure 1:
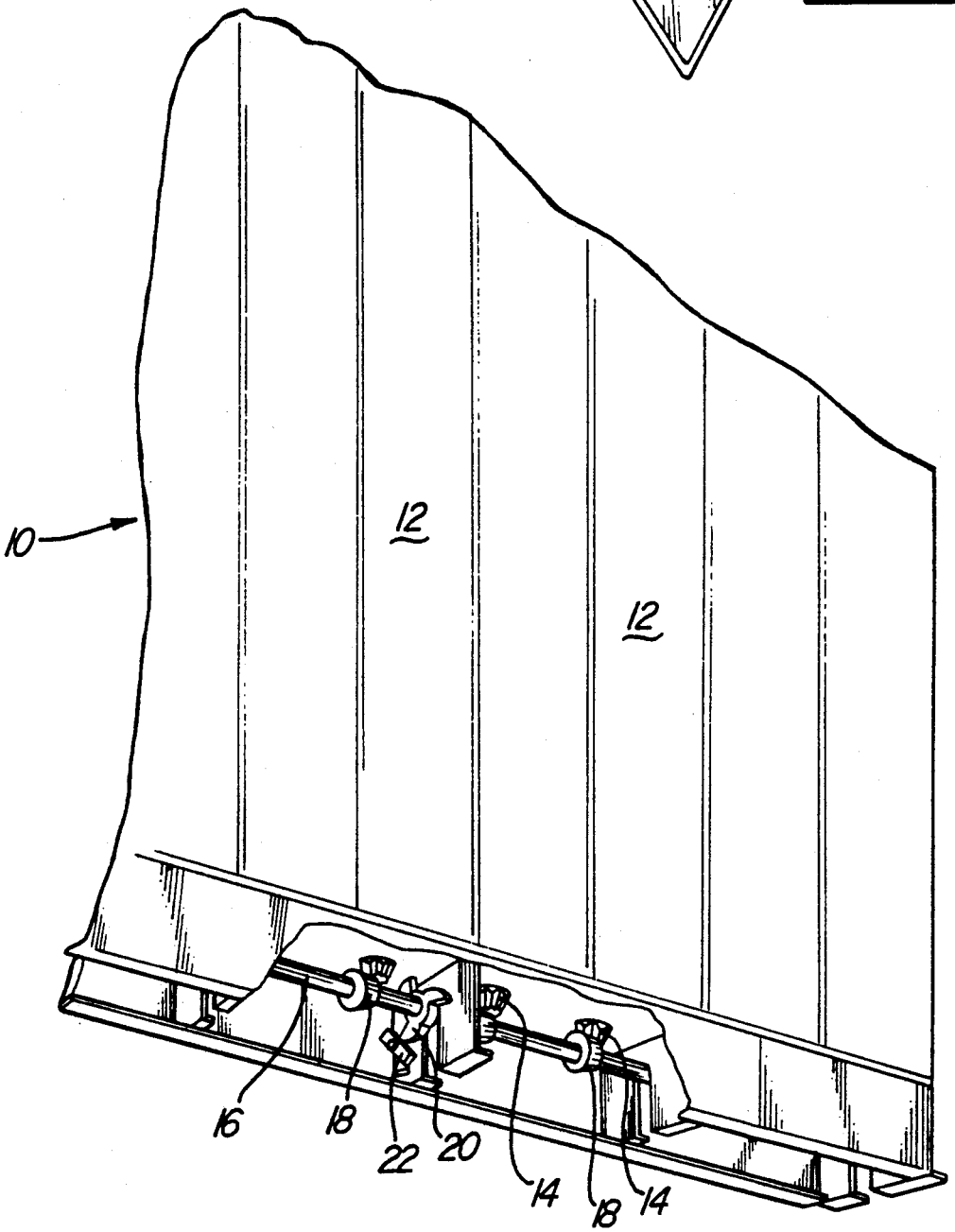
FIG. 1 is a perspective view of a rotating sign assembly partially sectioned.

Referring to FIG. 1, a rotating sign assembly according to the present invention is illustrated generally as 10. The assembly 10 comprises a plurality of rotatable sign segments 12. Each segment 12 is multi-sided, although the usual number of sides is three. In any event, each of the segments 12 must comprise an equal number of sides. The segments 12 present a collective image when all of the segments operate in unison. The image (a picture, an advertisement, or the like) changes as the segments 12 are rotated in unison. Accordingly, when a three-sided segment 12 is used, three images are possible, one at a time.

The segments 12 are parallel to one another. At the end of each segment 12 is a bevelled segment gear 14. A top view of one of the segments 12 is illustrated in FIG. 5 with the gear 14 in place.

Referring still to FIG. 1, a rotatable drive shaft 16 is transversely provided relative to the segments 12. The drive shaft 16 is provided with a number of bevelled drive shaft gears 18. The number of gears 18 is equal to the number of gears 14. According to this operable engagement, as the shaft 16 rotates, each of the segments 12 is likewise rotated.

The drive shaft 16 is fitted with at least one driven cam 20, although this number may be varied as required. The cam 20 is driven by at least one driving arm assembly 22. Again, the number of driving arm assemblies 22 may be varied as required, although this number is the same as the number of cams 18.

FIG. 1 illustrates the sign assembly 10 as having the segment 12 operating components situated at its underside. This arrangement minimizes damage from water, dirt or debris. However, it should be understood that these components could as well be situated at the top side of the assembly 10.

Figure 2:
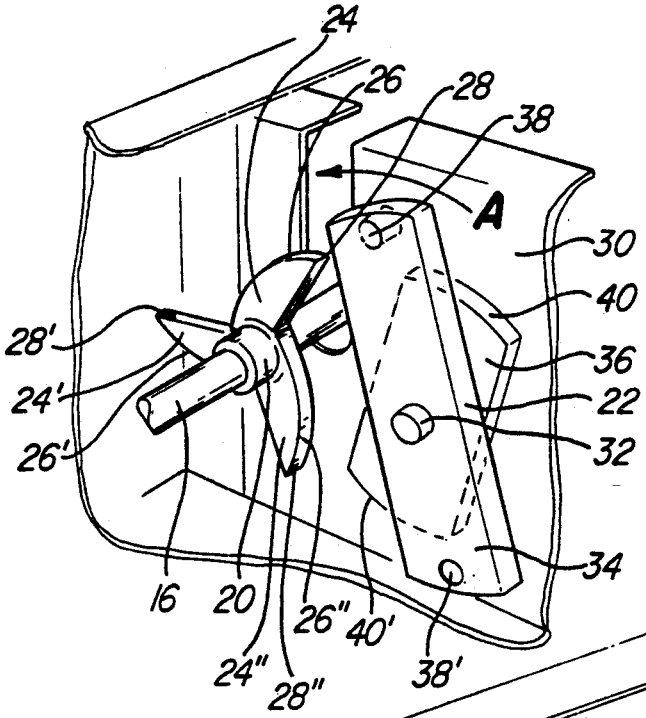
FIG. 2 is a detailed view of the operating mechanism of the present invention.

Referring to FIG. 2, the relationship and details of the cam 20 and the driving arm assembly 22 may be more fully and clearly understood.

The cam 20 is fixedly provided on the shaft 16. The cam 20 includes a plurality of arms 24, 24', 24''. As shown, and preferably, there are three arms. Each arm 24, 24', 24'' respectively defines an outer sloped driving surface 26, 26', 26'' which begins at the approximate center of the cam 20 and terminates at a peaked extremity 28, 28', 28''. As mentioned above, the slope may be varied as the speed of the rotation of the sign is selectively preferred.

The driving arm assembly 22 is driven by a motor 42 fixed to the back side of an assembly support plate 30. The motor includes a drive shaft 32.

Fitted to the drive shaft 32 and as elements of the assembly 22 are a driving pin plate 34 and a driven arm stop plate 36. A motor 42 (shown in FIG. 4) drives the drive shaft 32. The pin plate 34 and the stop plate 36 are fitted adjacent one another in an offset manner as illustrated. Accordingly, upon rotation of the pin plate 34 and the stop plate 36 in the direction of arrow "A", the stop plate 36 always trails the pin plate 34. This is the operating direction of the assembly 22.

The pin plate 34 is, as illustrated, an elongated plate having two driving pins 38, 38' fitted to each of its ends. Each of the pins 38, 38' extends from the pin plate 34.

The stop plate 36 is, also as illustrated, an elongated plate having two curved surfaces 40, 40' defined at its ends.

In operation, the pin plate 34 and the stop plate 36 rotate in unison in the direction of arrow "A". This movement causes the pin 38 to engage with the surface 26 of the arm 24 near the peaked extremity 28. Continuing in the direction of arrow "A", the pin 38 follows along the surface 26 toward the center of the cam 20 causing rotation of the shaft 16. This action is better illustrated in FIG. 3.

Figure 3:
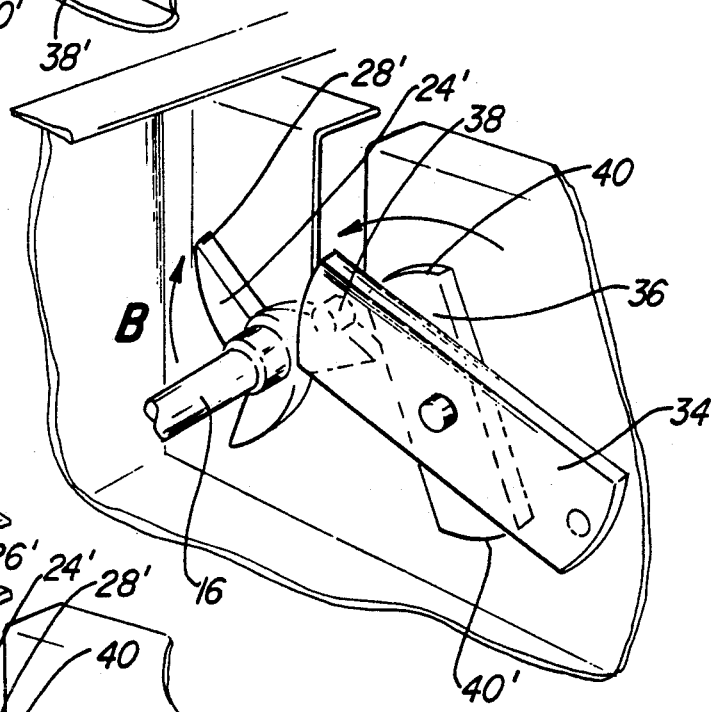
FIG. 3 is the view of FIG. 2 with rotation of the mechanism having been advanced.

With reference to FIG. 3, the pin 38 has travelled about one-half of the way along the surface 26 and the shaft 16 has thereby been caused to rotate in the direction of arrow "B".

Figure 4:
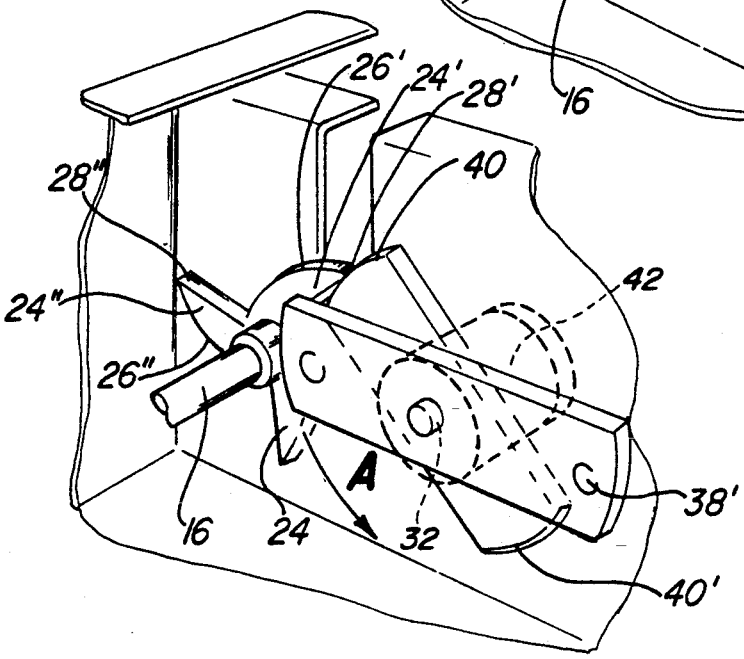
FIG. 4 is the view of FIG. 3 with rotation of the mechanism having been advanced still further.

The pin 38 continues its travel until it reaches the approximate end of the slope 26 as illustrated in FIG. 4. With reference thereto, the shaft 16 has been caused to rotate sufficiently whereby the pin 38, in its travel according to arrow "A", clears the arm 24 and is free to continue in its travel.

The rotational movement described above with respect to FIGS. 2 and 3 cause the segments 12 to rotate one cycle, or from one side to an adjacent side, thus bringing about a new collective image. However, the rotational movement must be halted, or the segments 12 would be free to rotate beyond their preferred stopping place wherein a uniform image is presented.

Accordingly, and still with reference to FIG. 4, after the pin 38 completes it travel along the surface 26, the peaked extremity 28' of the arm 24' abuts the curved surface 40 of the stop plate 36. This interfering action causes rotation of the shaft 16 and its associated segments 12 to temporarily be halted while the image created by the collective segments 12 is viewed by passersby.

All the while, however, rotation of the assembly 22 is continuing in the direction of arrow "A". This rotation continues through engagement of the pin 38' with the surface 26' of the arm 24' until halted by abutment of the peaked extremity 28'' against the surface 40' and so on through the cycles.

Having described my invention, however, many modifications thereto will become apparent to those skilled in the art to which it pertains without deviation from the spirit of the invention as defined by the scope of the appended claims.

I claim:

1. A rotating sign assembly comprising:

a plurality of rotatable multi-sided sign segments; and means for rotatably driving said plurality of sign segments, comprising:

a drive shaft rotatable about a first axis of rotation;

means connecting said drive shaft and said sign segments for rotating said segments upon rotation of said drive shaft about said first axis;

at least one multi-armed cam fitted to said drive shaft for rotation with said drive shaft, each arm of said at least one multi-armed cam having a convex driving surface and a linear stop abutment surface;

a driving arm assembly for rotating said drive shaft by interaction with said at least one multi-armed cam, said driving arm assembly comprising a driving plate, at least one driving pin affixed to said driving plate, and a stop plate affixed to and rotationally offset from said driving plate, said stop plate having a convex stop surface; and means for rotating said driving arm assembly about a second axis of rotation parallel to said first axis of rotation;

wherein said driving pin and said convex stop surface are spaced from said second axis of rotation;

wherein said driving pin interacts with said convex driving surface of one arm of said multi-arm cam to rotate said multi-armed cam through a predetermined angle by sliding abutment against said convex driving surface, and said convex stop surface interacts with said linear abutment surface of said next arm of said multi-arm cam to inhibit rotation of said multi-arm cam with the continued rotation of said driving arm assembly by sliding abutment against said linear stop abutment surface; wherein said alternating engagement of said first and second plates with said multi-armed cam intermittently rotates and suspends rotation of said multi-sided sign segments.

2. The rotating sign assembly of claim 1 wherein said driving plate is situated adjacent said stop plate.

3. The rotating sign assembly of claim 2 wherein said driving plate includes a first end and a second end.

4. The rotating sign assembly of claim 3 wherein one of said at least one driving pin is fitted at each of said first end and said second end.

5. The rotating sign assembly of claim 2 wherein said stop plate includes a first end and a second end.

6. The rotating sign assembly of claim 5 wherein each of said first end of said stop plate and said second end of said stop plate has a convexly curved surface.

7. The rotating sign assembly of claim 1 wherein said segments comprise a number of sides equal to the number of said arms of said multi-armed cam.

8. The rotating sign assembly of claim 7 wherein said number is three.

9. The rotating sign assembly of claim 1, wherein said means for rotating said driving arm assembly comprises a motor and a shaft driven by said motor to which said driving plate and stop plate are mounted.

10. The rotating sign assembly of claim 1, wherein said means connecting said drive shaft and said sign segments comprises a bevel gear fixed to each of said sign segments, and a matching plurality of bevel gears keyed to rotation with said drive shaft, wherein said fixed bevel gears engage with said gears on said sign segments.

11. An intermittent drive mechanism comprising:

a driven shaft;

a multi-armed cam attached to said driven shaft, each arm of said at least one multi-armed cam having a convex driving surface and a linear stop abutment surface;

means for alternately engaging opposite sides of each arm of said multi-armed cam in a predetermined sequence to respectively rotate and prohibit the rotation of said multi-armed cam; and a motor having a rotary output rotating said means for ultimately engaging to intermittently rotate said multi-armed cam;

wherein said means for alternately engaging comprises:

a first plate and a second plate attached to said rotary output of said motor, said second plate being angularly offset relative to said first plate, said first plate and said second plate alternately engaging said multi-armed cam;

a first pin fixed adjacent to said first end of said first plate and a second pin fixed adjacent to said second end of said first plate, said first pin and said second pin alternately engaging one of said convex driving surfaces of an arm of said multi-armed cam to intermittently rotate said multi-armed cam, and said second plate engages said linear stop abutment surface of a next arm of said multi-arm cam to inhibit rotation of said multi-arm cam with a continued rotation of said first and second plates.

12. The intermittent drive mechanism as defined in claim 11 wherein:

said multi-armed cam has an outer sloped driving surface and a peaked extremity on each arm, said outer sloped driving surface terminating at said peaked extremity; and wherein said first pin of said first plate engages said outer sloped driving surface of a first arm of said multi-armed cam and rotates said multi-armed cam in a first direction through a predetermined angle in response to the rotation of said first plate.

13. The mechanism according to claim 11 wherein said multi-armed cam has three cam arms.

14. The mechanism according to claim 11 further comprising at least one take-off gear on said drive shaft.

* * * * *